US008272108B2

(12) United States Patent
Langtry et al.

(10) Patent No.: US 8,272,108 B2
(45) Date of Patent: Sep. 25, 2012

(54) ADJUSTABLE LINK FOR USE WITH ELASTOMERIC STRAPS

(76) Inventors: Kenneth George Langtry, North Saanich (CA); Michael Alan Langtry, Chelsea (CA)

( * ) Notice: Subject to any disclaimer, the term of this patent is extended or adjusted under 35 U.S.C. 154(b) by 190 days.

(21) Appl. No.: 11/975,274

(22) Filed: Oct. 17, 2007

(65) Prior Publication Data

US 2008/0141506 A1 Jun. 19, 2008

Related U.S. Application Data

(60) Provisional application No. 60/852,478, filed on Oct. 17, 2006.

(51) Int. Cl.
*A44B 1/04* (2006.01)

(52) U.S. Cl. ..... 24/265 R; 24/265 H; 24/194; 24/369; 24/115 M; 24/195

(58) Field of Classification Search ..... 24/318, 24/265 H, 343, 345, 369, 194, 115 M, 196, 24/195

See application file for complete search history.

(56) References Cited

U.S. PATENT DOCUMENTS

| | | | | | |
|---|---|---|---|---|---|
| 27,714 | A | | 4/1860 | Hall | |
| 374,853 | A | * | 12/1887 | Smith | 24/195 |
| 650,785 | A | | 5/1900 | Warner | |
| 1,234,818 | A | | 7/1917 | Sturrock | |
| 1,514,227 | A | | 11/1924 | Prentice | |
| 1,679,306 | A | | 7/1928 | Hirsh | |
| 1,934,951 | A | | 11/1933 | Schaefer | |
| 2,084,412 | A | | 6/1937 | Schaefer | |
| D121,618 | S | | 7/1940 | Reiter | |
| 2,743,497 | A | * | 5/1956 | Davis | 24/196 |
| 2,754,560 | A | * | 7/1956 | Warner et al. | 24/196 |
| 2,938,254 | A | | 5/1960 | Gaylord | |
| 3,213,503 | A | * | 10/1965 | Alofs et al. | 24/196 |
| 3,591,900 | A | | 7/1971 | Brown | |
| 3,975,800 | A | | 8/1976 | Farlind | |
| 3,999,254 | A | | 12/1976 | McLennan | |
| 4,001,920 | A | | 1/1977 | Johnson | |
| 4,131,976 | A | * | 1/1979 | Bengtsson | 24/196 |
| 4,136,422 | A | * | 1/1979 | Ivanov et al. | 24/170 |
| 4,372,012 | A | * | 2/1983 | Fohl | 24/68 R |
| 4,473,926 | A | * | 10/1984 | Ono | 24/196 |
| 4,525,901 | A | | 7/1985 | Krauss | |
| 4,608,735 | A | * | 9/1986 | Kasai | 24/196 |

(Continued)

*Primary Examiner* — Robert J. Sandy
*Assistant Examiner* — Michael Lee
(74) *Attorney, Agent, or Firm* — Todd N. Hathaway

(57) ABSTRACT

An adjustable link assembly for use with a flat cross-section shock cord or other strap formed of elastomeric material. The adjustable link attaches the cord to a load-bearing member, such as a hook or other fitting, which may be formed integrally therewith. The link assembly includes a body member having an entrance/exit passage for the strap, and a sliding crossbar over which the free end of the strap is routed. When the main leg of the strap is tensioned, the crossbar is drawn against a stationary bridge piece of the body member, the crossbar and bridge piece having cooperating sloped surfaces that are angled in a reverse direction from a straight line path from the top of the crossbar to the opening of the entrance/exit passage. The cooperating faces thus force the strap into a reverse bend or kink, which locks the strap in position so long as the main leg of the strap is subjected to tension. When the tension is relieved, the elastomeric material of the strap pushes the crossbar back away from the stationary bridge piece, straightening the kink and releasing the strap so that its length can be adjusted, without the user having to manipulate the link assembly itself.

13 Claims, 2 Drawing Sheets

U.S. PATENT DOCUMENTS

D287,067 S 12/1986 Kasai
4,871,190 A * 10/1989 Willey ..... 280/801.1
4,903,378 A * 2/1990 Kasai ..... 24/196
5,317,788 A 6/1994 Esposito et al.
5,331,726 A * 7/1994 Suh ..... 24/625
5,771,544 A * 6/1998 Wier et al. ..... 24/171
6,148,486 A * 11/2000 Uehara et al. ..... 24/170

* cited by examiner

ADJUSTABLE LINK FOR USE WITH ELASTOMERIC STRAPS

RELATED APPLICATIONS

This application claims the benefit of U.S. Provisional Patent Application Ser. No. 60/852,478 filed on Oct. 17, 2006.

BACKGROUND a. Field of the Invention

The present invention relates generally to adjustable fittings for use with straps and cords, and, more particularly, to an adjustable link that functions cooperatively with an elastomeric strap having a flattened cross-section.

b. Related Art

Links of various kinds (e.g., buckles, couplings and other forms of fittings) have long been used with various kinds of straps. Some of the simplest are basic belt buckles and double-D rings; other examples include clasp-type fittings, in which a pivoting part engages the strap (e.g., suspender buckles), and buckles/strap adjusters that utilize sliding bar mechanisms. Examples of the latter in the prior art include the devices shown in U.S. Pat. No. 1,514,227 (Prentice); U.S. Pat. No. 2,743,427 (Davis); U.S. Pat. No. 2,938,254 (Gaylord); U.S. Pat. No. 3,975,800 (Färlind); U.S. Pat. No. 3,999,254 (McLennon); U.S. Pat. No. 4,131,976 (Bengtsson); U.S. Pat. No. 4,608,735 (Kasai); U.S. Pat. No. 4,525,901 (Kraus); U.S. Pat. No. 5,317,788 (Esposito et al.) and U.S. Pat. No. 5,331,726 (Suh). In general, the object of the devices is to hold the strap when under tension, but allow the length of the strap to be adjusted as necessary.

Although many types of adjustable links are therefore known in the art, they tend to share a number of deficiencies. To begin with, most are to a greater or lesser degree somewhat "fiddly" to operate, especially when being released in order to adjust the length of the strap. Many also employ somewhat complex mechanisms with multiple parts, which impacts not only the cost of the device but often its long term durability as well. Many are also inherently limited to metal construction, which again is relatively costly and also presents a number of other drawbacks; for example, metal tends to abrade/scratch adjoining materials and surfaces, and also is far more likely to cause injury (e.g., an eye injury) in the event that it comes loose, particularly if the strap is under a load.

In addition, prior types of adjustable links have used bars, jaws or other mechanisms or structures that dig into or bite against the strap in a manner that is ultimately harmful to the material of the latter, especially over extended use. Given the characteristics of traditional strap materials with which these devices have been used (e.g., nylon webbing), the inherent damage (e.g., fraying and crushing/kinking of fibers) was deemed acceptable since the overall strength of the strap remained largely intact, at least for a service life of adequate length. However, for newer, elastomeric-type straps, formed of rubber or similar materials, such damage is unacceptable since it is liable to lead to complete failure of the strap and potentially hazardous consequences, especially when the strap is under a heavy tension load.

Accordingly, there exists a need for an adjustable link for use with a strap, that is quick and convenient to use, and avoids the need to "fiddle" excessively with the mechanism and/or strap to release the latter for adjustment. Furthermore, there exists a need for such a link that operates without causing damage to the material of the strap, particularly modern straps formed of an elastomeric material. Still further, there exists a need for such a link that can be used with a wide range of fittings that may be employed with such straps. Still further, there exists a need for such a link that is economical to produce, light in weight, durable, and unlikely to present a hazard to personnel and/or surrounding materials/surfaces during use.

SUMMARY OF THE INVENTION

The present invention has solved the problems cited above, and is an adjustable link assembly for use with an elastomeric strap. In a broad aspect, the adjustable link assembly comprises: (a) a body member having an entrance/exit passage that holds a first, main leg of the strap and a second, free or tail leg of the strap in closely-spaced relationship atop one another; (b) a sliding crossbar member that is located at a position offset from the entrance/exit passage, over which the free leg of the strap is routed to an opening of the entrance/exit passage; (c) a stationary sloped face on the portion of the body member located adjacent the opening of the entrance/exit passage, the stationary sloped face being angled in a reverse direction from a direct line path between the crossbar member and the opening; and (d) a cooperating sloped face on the sliding crossbar member that faces towards and is angled generally parallel to the stationary sloped face; the crossbar member being slideable such that when tension is applied to the main leg of the strap the crossbar member is drawn against the portion of the body member so that the free end of the strap is bent between the sloped surface into a generally reverse bend from the direct line path and thereby locked within the link assembly, and such that when tension is slackened from the main leg the free leg of the elastomeric strap presses the crossbar back away from the stationary portion of the body member so that the free leg of the strap is returned to the direct line path and thereby freed to slip through the link assembly.

The body member may further comprise first and second substantially parallel sidewall portions that define a generally open interior of the body member, and means for supporting the crossbar member in transverse, sliding relationship between the sidewall portions. The means for supporting the crossbar member in transverse, sliding relationship between the sidewall portions of the body member may comprise first and second parallel, generally lengthwise guide channels formed in the sidewall portions of the body member, the guide channels having ends of the crossbar member received for sliding movement therein. The guide channels may comprise first and second guide slots formed in the sidewall portions of the body member, and the crossbar member may comprise first and second projecting tab portions on the ends thereof that extend through the guide slots beyond the first and second sidewall portions, so as to enable a user to manually slide the crossbar member by gripping the tab portions between fingers of a hand.

The body member may further comprise a transverse bridge portion that extends transversely between the first and second sidewall portions so as to define a side of the entrance/exit passage. The stationary sloped surface may comprise a sloped surface on the bridge portion and the sloped surface on the crossbar member may comprise a sloped surface formed on a side of the crossbar member that faces towards the bridge portion. The guide channels may extend substantially in line with the bridge portion and parallel to but offset from the entrance/exit passage of the body member.

The crossbar member may comprise an upper surface over which the tali leg of the strap is routed, the upper surface having a leading edge from which the strap slopes downwardly to the opening of the entrance/exit passage. The sloped surface of the crossbar member may comprise an undercut surface that meets the upper surface of the crossbar member at an acute angle at the leading edge, so that the free leg of the strap is bent through an acute angle thereover when the crossbar member is drawn against the bridge portion of the body member. The crossbar member may further comprise a plurality of teeth formed on the leading edge that press into and engage an elastomeric material of the strap when the strap is bent to the acute angle thereover.

The first and second guide channels may comprise end stops that limit travel of the sloped surface on the crossbar member towards the sloped surface on the bridge portion of the body member, so as to prevent said sloped surfaces from crushing the elastomeric material of the strap.

The link assembly may further comprise an attachment fitting that is formed integrally with the body member. The attachment fitting may be a hook, for example.

These and other feature and advantages of the present invention will be more fully appreciated from a reading of the following detailed description with reference to the accompanying drawings.

DETAILED DESCRIPTION

Figure 1:
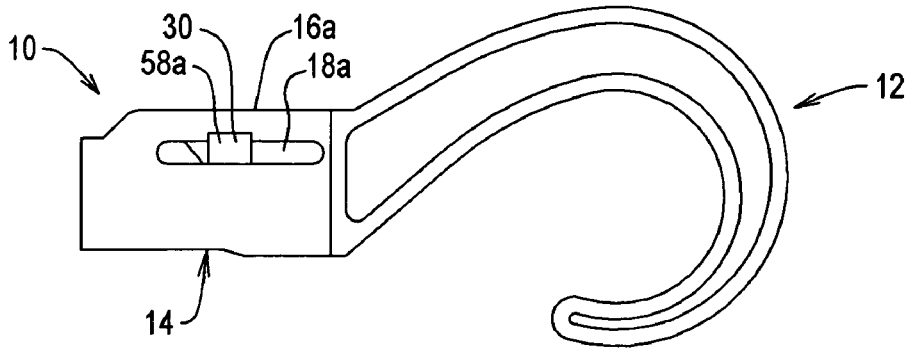
FIG. 1 is an elevational view of an adjustable link in accordance with the present invention, formed as part of an exemplary hook assembly.

FIG. 1 shows an adjustable link 10 in accordance with the present invention. In the illustrated example, the link is formed integrally with a hook 12, being molded into the base portion of the latter; however, it will be understood that the adjustable link of the present invention may be used with any other suitable attachments, couplings or fittings, especially those that are suitable for use with the elastomeric cord material to which the present invention is particularly adapted. Both the link and attachment fitting (the hook 12, in FIG. 1) are suitably formed of molded plastic material, which is both inexpensive and durable and also light in weight so as to reduce the possibility of presenting a hazard in the event that the fitting comes loose from its hold, and which is also unlikely to abrade/scratch or otherwise damage surrounding materials and surfaces.

Figure 2:
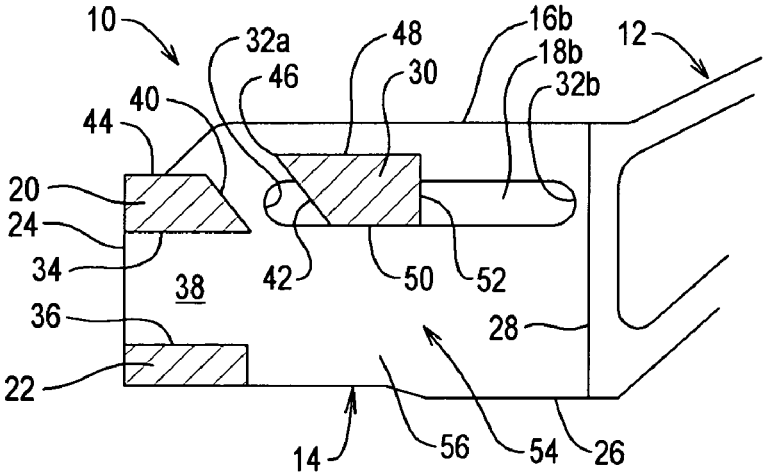
FIG. 2 is a cross-sectional view of the adjustable link of FIG. 1, showing the internal structure and components thereof in greater detail.

As can be seen in FIG. 1 and also FIG. 2, the adjustable link 10 includes a body portion 14 formed by generally parallel wall portions 16*a*, 16*b* having lengthwise extending slots 18*a*, 18*b* formed therein. First and second bridge pieces 20, 22 extend between the wall portions at a first end 24 (referred to from time-to-time hereinafter as the base end). At the other end 26 of the link (referred to from time-to-time hereinafter as the distal end) the wall portions are joined by the base 28 of the hook 12 (or other attachment fitting).

A transverse bar member 30 spans the sidewalls and is retained in sliding engagement with the slots 18*a*, 18*b*, with longitudinal movement of the crossbar being limited by the closed ends 32*a*, 32*b* of the slots.

As can be seen in FIG. 2, the opposing lower and upper surfaces 34, 36 of the stationary bridge pieces 20, 22 extend generally parallel to one another, so that in combination with the parallel sidewalls 16*a*, 16*b* they define a generally rectangular passage or sleeve 38 at the base end of the housing 14, through which the strap enters/exits the link 10.

As can be seen with further reference to FIG. 2, the upper bridge piece 20 also includes a forward wall 40, facing towards the sliding bar 30, that extends upwardly at a reverse, acute angle to the axis of the entrance/exit sleeve 38. The rearward face 42 of the crossbar is correspondingly angled, so that the two surfaces extend substantially parallel to one another, i.e., at the acute rearward angle relative to the entrance/exit passage. The rearward face 42 of the crossbar terminates at a level somewhat above the upper side 44 of the upper bridge piece 20, in an edge that is preferably provided with a series of relatively shallow teeth 46. The upper surface 48 of the crossbar, in turn, extends forwardly from the toothed edge 46 in a direction generally parallel to that of the entrance/exit passage, while the lower face 50 of the bar extends generally parallel to the upper surface and lies approximately level with or slightly above the upper wall 34 of the entrance/exist passage. The front face 52 of the bar extends generally perpendicular to its upper and lower surfaces 48, 50, and is therefore also substantially perpendicular to the entrance/exit passage in sleeve 38. It will be understood that the terms "upper", "lower", "forward", "rear" and the like are used herein for ease of illustration and explanation, referring to the link in the orientation that is shown in the drawings, and that the actual orientation will of course vary with the position of the device during use.

In short, it can be seen from FIG. 2 that the interior of the link body can be considered as being made up of three principal areas, i.e., the rectangular entrance/exit passage 38, a main opening or chamber 54 that is located between the wall portions 16*a*, 16*b* forwardly of the entrance/exit passage, and that has an open lower side 56, and a strap engaging/bending area that includes the crossbar and face of the upper bridge piece 20, and that is located generally above the level of the entrance/exit passage 38 and the main chamber 54. It will also be noted that the operative faces of the components (e.g., the sleeve, upper bridge piece and crossbar) are all preferably flat (planar) so that the elastomeric strap will be bent/kinked through sharp angles when locked within the link, as will be described in greater detail below; however, it will be understood that in some embodiments certain of these surfaces may have other shapes, e.g., the upper and lower walls of the sleeve 38 may be angled/tapered in order to aid insertion of the strap into the assembly.

Figure 3:
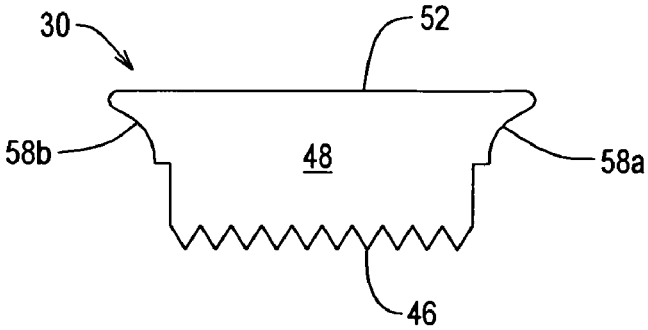
FIG. 3 is a plan view of the transverse, sliding bar member of the adjustable link of FIG. 2.

As can be seen in FIG. 3 and also in FIG. 1, the slideable crossbar 30 preferably includes laterally extending flanges or tab portions 58*a*, 58*b*, having a transverse width such that they project outwardly beyond the sidewalls 16*a*, 16*b* of the link body 14. The tab portions allow the crossbar to be slid manually away from the bridge piece when initially threading the strap into the link assembly, and include concavely contoured faces for convenient engagement by the thumb and forefinger of the user's hand.

Figure 4:
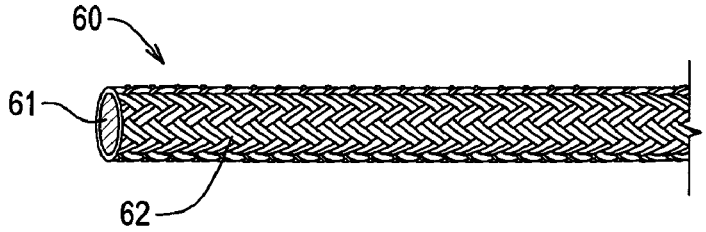
FIG. 4 is a perspective view of a cut end portion of an elastomeric strap that is utilized with the adjustable link of FIGS. 1-2.

FIG. 4 shows an elastomeric strap 60 of the type with which the adjustable link of the present invention is primarily intended to be used. As can be seen, the strap 60 is similar in construction to a conventional elastomeric shock cord (sometimes referred to as a "bungee" cord), with an elastomeric core 61 formed of synthetic rubber material or the equivalent and a braided cover 62, but having a generally flattened rather than circular cross-section. In the illustrated example, the flattened cross-section of the strap has a shallow elliptical configuration, but it will be understood that in other instances the cross-section may have flatter (i.e., more planar) upper and lower sides or other configurations. Moreover, in some instances the elastomeric strap may have multiple cores arranged generally flat next to one another, rather than the single core that is shown. Suitable flat shock (bungee) cords are available from suppliers in China and the United States.

Figure 5A:
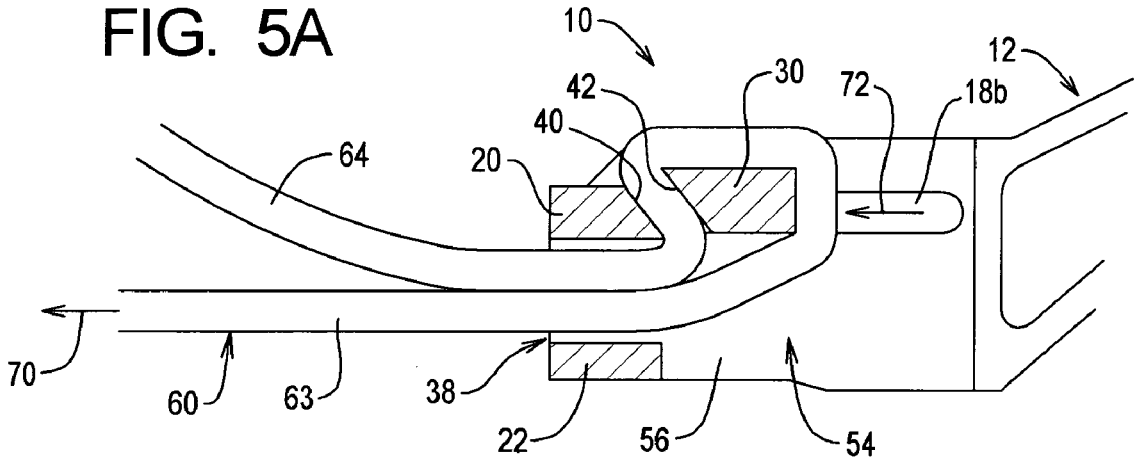
FIGS. 5A-5B are cross-sectional views, similar to FIG. 2, showing the manner in which the components of the link cooperate with the elastomeric material of the strap, to crimp the strap and lock it in position when the strap is under tension, and to release the strap from its kinked configuration so that its length can be adjusted when tension on the strap is relieved.
Figure 5B:
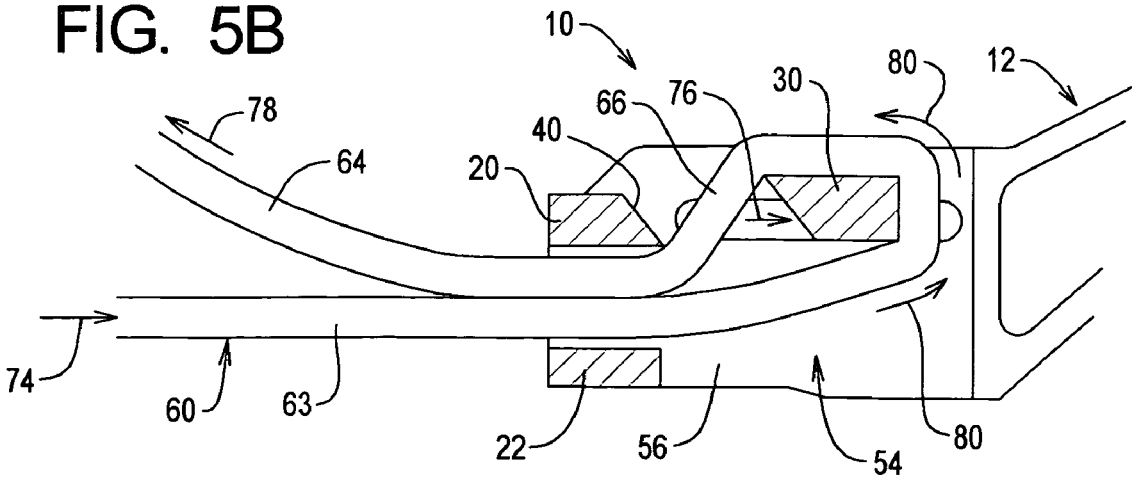

As is shown in FIGS. 5A-5B, the cord 60 enters the link 10 through the entrance/exit passage of the rectangular sleeve 38, with the main (tensioned) leg 63 lying on top of the lower bridge piece 22. The strap then passes through the main interior opening 54 and under the sliding bar 30, and then back over the top of the bar. The free leg 64 of the strap then passes back into the forward entrance opening of the rectangular passage and through the sleeve portion 38 atop the first, main leg 63. The rectangular passage in the sleeve portion is approximately equal in height and width to the doubled cord, so that the two legs (i.e., the main and free legs 63, 64) are positioned closely atop and parallel to one another as shown in FIGS. 5A-5B.

As noted above, the sliding bar 30 is positioned forwardly of and above the upper edge of the passage through the sleeve portion 38. As a result, the natural, straight-line path of the upper (free) leg 64 of the strap is at a downward angle, from the top of the bar into the forward entrance of the sleeve, in the area indicated at 66 in FIG. 5B. As was also noted above, the rearward face 42 of the sliding bar is sloped in the opposite direction, as is the forward face 40 of the stationary bridge piece 20, so that these two faces define an opening or passage that extends at a reverse angle relative to the natural straight-line path of the strap.

Consequently, when the cord in tensioned, as indicated by arrow 70 in FIG. 5A, the sliding bar 30 is drawn rearwardly, as indicated by arrow 72, so that the two surfaces 40, 42 cooperate to force (i.e., "kink") the strap through reverse bend at an acute angle, thus binding the strap so that it will not slip through the link. The small teeth at the upper edge 46 of the crossbar (see FIG. 2) also press into the strap to enhance the grip. However, the rearward ends of the two slots 18*a*, 18*b* are located to act as stops that prevent the face 42 of the bar from pressing all the way against the opposing surface 40, obviating the possibility of crushing/cutting or otherwise damaging the rubber core of the elastomeric strap. In this manner, the link and its associated fitting (e.g., hook 12) are held firmly in place with no slippage of the strap.

When tension is subsequently released, as indicated by arrow 74 in FIG. 5B, the resilient material of the strap causes it to bend back towards its original, straight-line path, from the top of the bar 30 to the opening of the rectangular sleeve 38. This angle, as noted above, is substantially the reverse of that of the sloped faces 40, 42 of the sliding bar and bridge piece, so that as a result the bar is pushed back forwardly by the action of the resilient material, as indicated by arrow 76 in FIG. 5B, thus releasing the cord from its "kinked" configuration. The main leg of the strap (i.e., the leg connecting the two hooks or other attachment fittings) can then be shortened by simply pulling on the free end of the cord, in the direction indicated by arrow 78. As this is done, the cord will slip through the fitting with minimal resistance, rounding the bar in the direction indicated by arrows 80. Adjustment in the opposite direction can be achieved by simply pushing the free end of the strap into the body of the link, so that its upper loop rises free of bar 30, then pressing the loop down out the open bottom 56 of the body and drawing outwardly on the main leg of the strap. However, when tension is again exerted on the main leg, the bar is drawn back rearwardly to lock the link in place, in the configuration shown in FIG. 5A. The strap can thus be adjusted in a rapid and convenient manner, with a couple of quick actions of the hand and no "fiddling" of the pieces.

It is to be recognized that various alterations, modifications, and/or additions may be introduced into the constructions and arrangements of parts described above without departing from the spirit or ambit of the present invention as defined by the appended claims.

What is claimed is:

1. An adjustable link assembly with an elastomeric strap having a flattened cross-section, said adjustable link assembly comprising:

a body member having a generally rectangular entrance/exit passage comprising first and second end openings and substantially parallel upper and lower walls and first and second side walls spaced to hold a first, main leg of said strap and a second, free leg of said strap together in parallel closely-spaced relationship atop one another;

a sliding crossbar member that is mounted in said body member at a position proximate and offset from said second end opening of entrance/exit passage, said crossbar member comprising an upper surface over which said free leg of said strap is routed, said upper surface having a leading edge from which said strap slopes downwardly to said second end opening of said entrance/exit passage;

a stationary sloped face formed on a portion of said body member adjacent said second end opening of said entrance/exit passage engaging a first side of said free leg of said strap that is routed to said opening, said stationary sloped face being angled generally in a plane that extends in a reverse direction from a direct line path between leading edge of said upper surface of said crossbar member and said second end opening of said entrance/exit passage; and a cooperating sloped face formed on said sliding crossbar member engaging a second side of said free leg of said strap that is routed to said opening, said cooperating sloped face on said crossbar member facing towards said stationary sloped face on said body member and extending generally parallel to said stationary sloped face, said cooperating sloped face of said sliding crossbar meeting said upper surface of said crossbar member at an acute angle to form a sharp leading edge, whereby in response to tension being applied to said main leg of said strap in said entrance/exit passage said crossbar member is drawn against said portion of said body member so that said free end of said strap is bent between said sloped surfaces into a generally reverse bend from said direct line path and said sharp leading edge is forced into said elastomeric strap so as to lock said strap within said link assembly, and in response to tension being slackened from said main leg of said strap in said entrance/exit passage said free leg of said elastomeric strap presses said crossbar away from said portion of said body member so that said free leg of said strap is freed from between said sloped surfaces to return to said direct line path so as to release said strap to slip through said link assembly.

2. The adjustable link assembly of claim 1, wherein said body member comprises:

first and second substantially parallel sidewall portions that define a generally open interior of said body member; and means for supporting said crossbar member in transverse, sliding relationship between said sidewall portions.

3. The adjustable link assembly of claim 2, wherein said means for supporting said crossbar member in transverse, sliding relationship between said sidewall portions of said body member comprising:

first and second parallel, generally lengthwise guide channels formed in said sidewall portions of said body member, said guide channels having first and second ends of said crossbar member received for sliding movement therein.

4. The adjustable link assembly of claim 3, wherein said guide channels in said first and second sidewalls portions of said body member comprise:

first and second guide slots formed in said sidewall portions of said body member.

5. The adjustable link assembly of claim 4, wherein said crossbar member further comprises:

first and second projecting tab portions on said ends of said crossbar member that extend through said guide slots beyond said first and second sidewall portions of said body member, so as to enable a user to manually slide said crossbar member by gripping said tab portions between fingers of a hand.

6. The adjustable link assembly of claim 3, wherein said body member further comprises:

a transverse bridge portion that extends transversely between said first and second sidewall portions so as to define said upper wall of said entrance/exit passage.

7. The adjustable link assembly of claim 6, wherein said stationary sloped face comprises:

a sloped face formed on said bridge portion that extends transversely between said first and second sidewall portions of said body member.

8. The adjustable link assembly of claim 7, wherein said cooperating sloped face on said crossbar member comprises:

a sloped face formed on a side of said crossbar member that faces towards said sloped face on said bridge portion of said body member.

9. The adjustable link assembly of claim 8, wherein said guide channels extend substantially in line with said bridge portion of said body member having said sloped face thereon, and substantially parallel to but offset from said entrance/exit passage of said body member.

10. The adjustable link assembly of claim 1, wherein said crossbar member further comprises:

a plurality of teeth formed on said leading edge that press into said elastomeric strap when said strap is bent to said acute angle thereover.

11. The adjustable link assembly of claim 9, wherein said first and second guide channels comprise:

end stops that limit travel of said sloped surface on said crossbar member towards said sloped surface on said bridge portion of said body member, at a spacing that prevents said sloped surfaces from crushing said elastomeric material of said strap.

12. The adjustable link assembly of claim 9, further comprising:

an attachment fitting formed integrally with said body member.

13. The adjustable link assembly of claim 12, wherein said attachment fitting comprises a hook.

* * * * *